US005549290A

United States Patent [19]

Long et al.

[11] Patent Number: 5,549,290

[45] Date of Patent: Aug. 27, 1996

[54] CURVED ENVELOPE HOPPER

[75] Inventors: Douglas G. Long, Naugatuck; Roman Czernik, Trumbull, both of Conn.

[73] Assignee: Pitney Bowes Inc., Stamford, Conn.

[21] Appl. No.: 396,983

[22] Filed: Mar. 1, 1995

[51] Int. Cl.[6] ..... B65H 1/24

[52] U.S. Cl. ..... 271/166; 271/167; 271/171

[58] Field of Search ..... 271/35, 121, 124, 271/161, 165, 166, 167, 171, 2

[56] References Cited

U.S. PATENT DOCUMENTS

| | | | |
|---|---|---|---|
| 1,637,833 | 8/1927 | Mueller | 271/124 |
| 3,612,511 | 10/1971 | Godlewski | 271/35 |
| 3,902,712 | 9/1975 | Dorer | 271/167 |
| 3,908,983 | 9/1975 | Long | 271/171 |
| 3,933,350 | 1/1976 | Mingano | 271/165 |
| 4,192,496 | 3/1980 | Baselice et al. | 271/165 |
| 4,362,100 | 12/1982 | Wu | 101/233 |
| 4,607,833 | 8/1986 | Svyatsky et al. | 271/10 |
| 4,635,922 | 1/1987 | Roetter | 271/119 |
| 4,715,593 | 12/1987 | Godlewski | 271/165 |
| 5,088,718 | 2/1992 | Stephan | 271/161 |

*Primary Examiner*—H. Grant Skaggs

*Attorney, Agent, or Firm*—Ronald Reichman; Brigitte L. Jeffery; Melvin J. Scolnick

[57] ABSTRACT

An envelope hopper including a rear panel and a pair of side panels extending forward from the rear panel. A convex curved deck is mounted to the rear panel. The deck extends between a rearmost section of the side panels. The deck has a receiving end and a feeding end for supporting a stack of envelopes. The deck has at least one convex curved side extending upwardly from the deck. A bottom panel is positioned below the feeding end of the deck and extends between the side panels thereby positioning the envelopes for passage from the envelope hopper.

16 Claims, 2 Drawing Sheets

CURVED ENVELOPE HOPPER

BACKGROUND OF THE INVENTION

The subject invention relates to an envelope hopper for a mailing machine, and more particularly, a hopper having a large, storage capacity.

Inserting machines typically include a plurality of feeding devices which feed documents from a pack of documents situated in a hopper seriatim to a transport deck therebelow, from which a collated packet of documents are eventually inserted into an envelope. The envelopes are fed from a hopper seriatim to the transport deck to receive the documents. The envelope feeders employ hoppers that generally are inclined at a fixed angle which usually is somewhere between about 20 and 30 degrees. The feeder depends on gravity to slide the documents down to and against a separator roller and stone for seriatim feeding.

As shown in U.S. Pat. No. 4,635,922 for an Envelope Feeding Apparatus, issued Jan. 13, 1987 to Frank Roetter. et al, and assigned to the assignee of the present invention, it is known in the art to have a hopper oriented at an acute angle with respect to a horizontal plane. Moreover, as shown in U.S. Pat. No. 5,088,718 for a High Capacity Sheet Feeder, issued Feb. 18, 1992 to Constance R. Stepan, et al, and assigned to the assignee of the present invention, it is known in the art to provide a main urge roller situated midway between the top and bottom edges of the sheet stack such that the stack is bent at a point about midway between the top and bottom edges. A secondary feed roller is parallel to and situated above the main urge roller near the top edge of the stack such that a line of tangency joining the peripheries of the urge roller and the secondary feed roller is disposed at an angle between 40 and 50 degrees to a horizontal plane.

Stacks for feeding documents can be oriented in a variety of angularly sloping directions to achieve particular, desired objectives. Typically, in such a configuration, there is a limit to the size of a stack that can be used because at a certain point, the pressure and weight becomes too great for effective, efficient feeding and separation.

Notwithstanding the aforesaid prior art, there has been a long felt and as yet unsatisfied need to provide an envelope hopper wherein the hopper is constructed and arranged for providing a large, storage capacity for a stack of envelopes.

SUMMARY OF THE INVENTION

The present invention is directed to an envelope hopper that satisfies the aforementioned needs. An envelope hopper having features of the present invention comprises a rear panel and a pair of side panels extending forward from the rear panel. A convex curved deck is mounted to the rear panel. The deck extends between a rearmost section of the side panels. The deck has a receiving end and a feeding end for supporting a stack of envelopes. The deck has at least one convex curved side extending upwardly from the deck. A bottom panel is positioned below the feeding end of the deck and extends between the side panels thereby positioning the envelopes for passage from the envelope hopper.

DESCRIPTION OF THE PREFERRED EMBODIMENT

Figure 1:
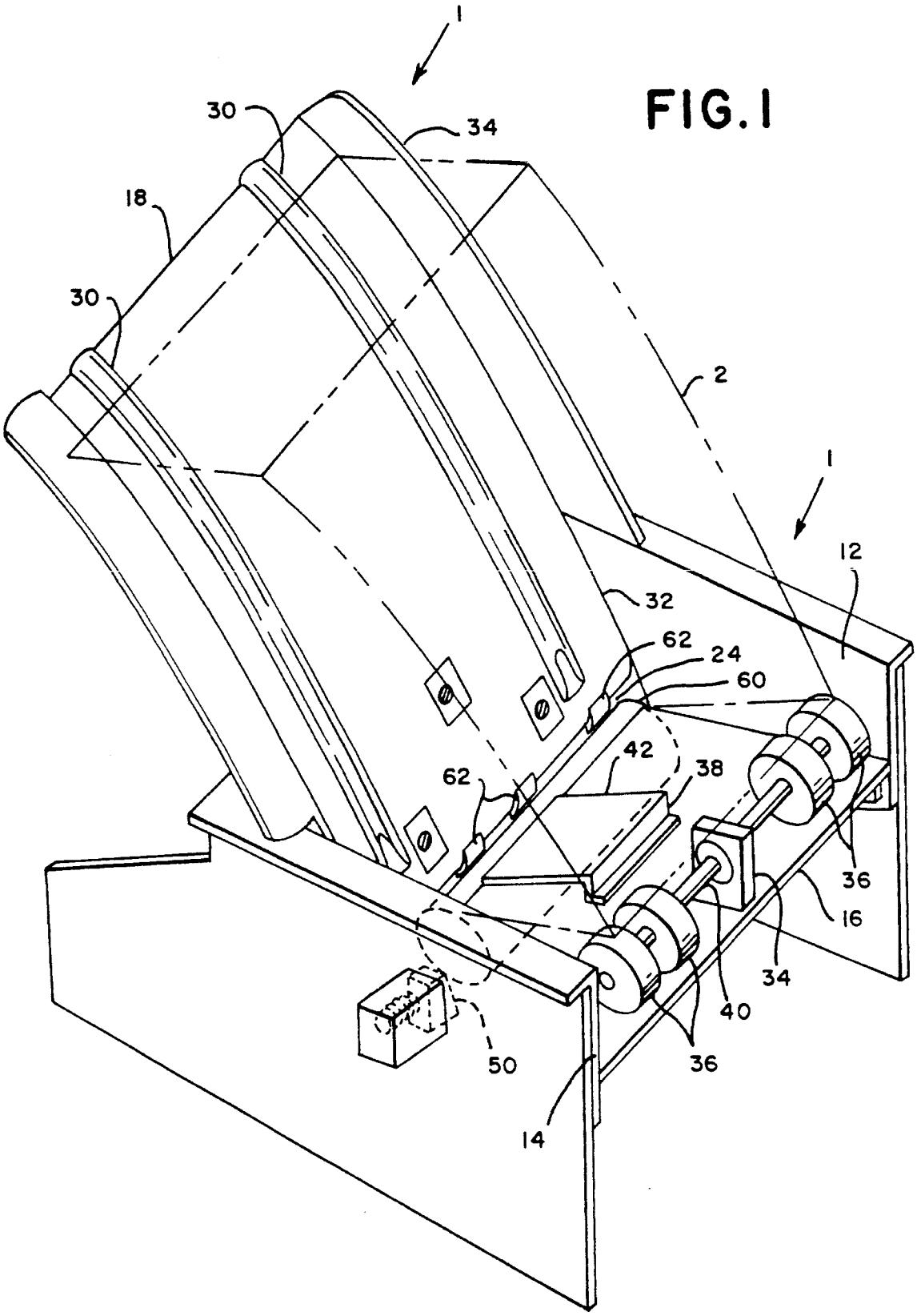
FIG. 1 is a perspective view of an envelope hopper in accordance with the instant invention.
Figure 2:
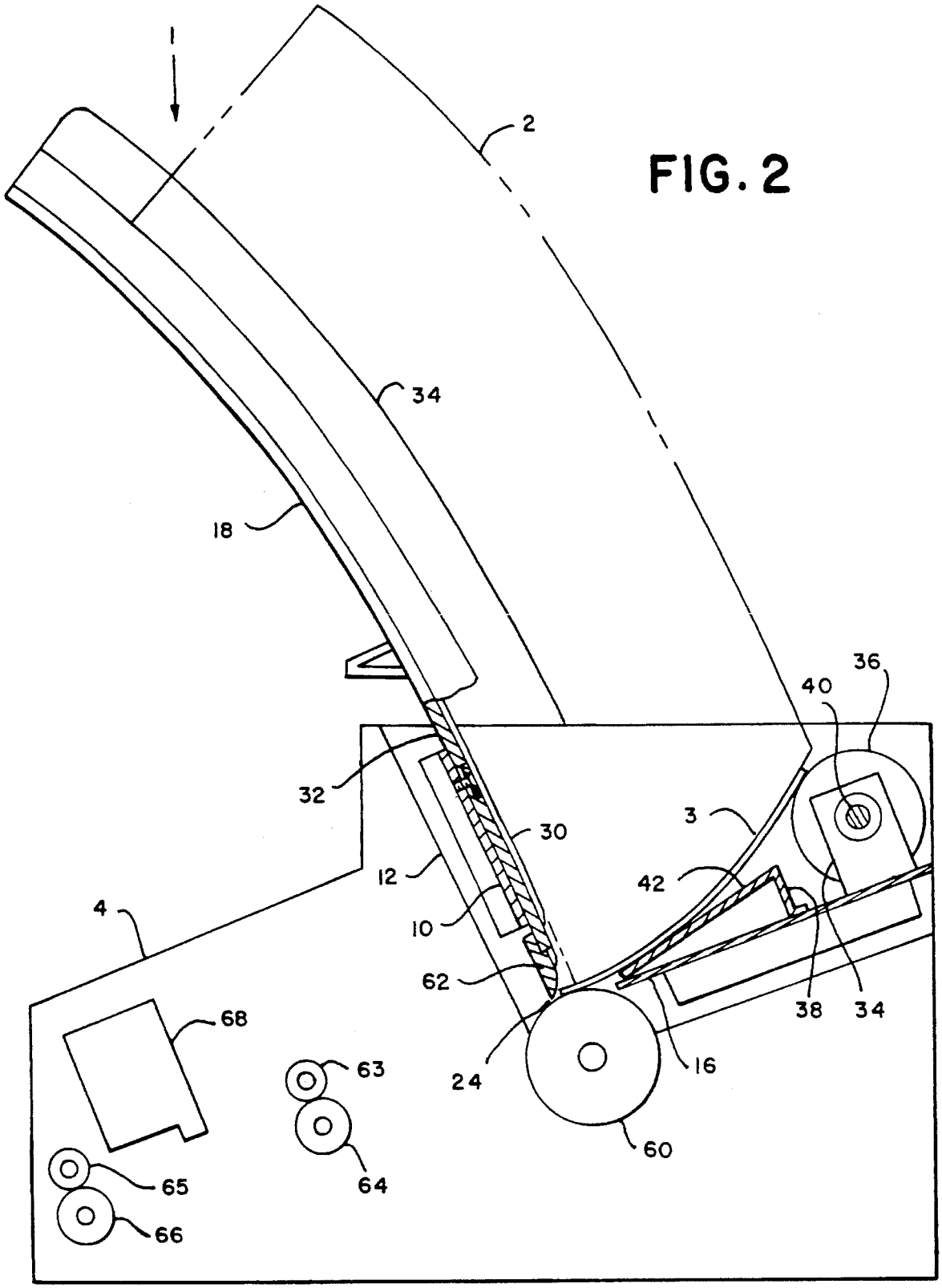
FIG. 2 is a side elevational view of the envelope hopper.

As shown in FIG. 1 and FIG. 2, there is an envelope hopper generally designated 1 for holding a stack of envelopes 2. The envelope hopper 1 includes a rear panel 10 and a pair of side panels 12, 14 which extend forward from the rear panel 10. Side panel 14 includes a spring biased aligner 50 for urging the stack of envelopes 2 against side panel 12.

The envelope hopper 1 further includes a convex, curved deck 18 mounted to the rear panel 10. In a preferred embodiment of the invention, the convex section of deck 18 has a radius between 500 and 800 mm. The lower end of the deck 18 is the feeding end, while the upper end of the deck 18 is the receiving end. A plurality of ribs 30 extend along the curved deck 18 from the feeding end to the receiving end. The deck 18 further includes a convex, curved side 34 which extends upward from the deck 18. Side 34 acts as a registration edge as the stack of envelopes 2 travel from the receiving end of deck 18 to the feeding end of deck 18. In a preferred embodiment of the invention, the curvature of curved deck 18 extends from the receiving end to the feeding end. In the preferred embodiment, the curved deck 18 is mounted to the rear panel 10. In an alternative embodiment of the invention, the curved deck 18 has a substantially linear bottom portion 32 which is mounted to the rear panel 10.

A bottom panel 16 is positioned below the feeding end of the deck 18 and extends between the side panels 12, 14. Bottom panel 16 is oriented at an angle of 20 degrees to the horizontal. Bracket 34 is fixedly mounted to the bottom panel 16. A plurality of rollers 36 rotate about shaft 40 which is pivotally mounted to bracket 34. The plurality of rollers 36 are situated to support the envelope flap and trailing edge of the bottom-most envelope 3. A support ramp 38 is fixedly mounted to the bottom panel 16 and extends from the rear of the bottom panel 16 to a point substantially near the periphery of rollers 36. The inclined surface 42 of support ramp 38 is oriented at an angle of approximately 35 degrees to the horizontal. Support ramp 38 supports the body of the bottom-most envelope 3 so that the envelope stack 2 remains properly aligned prior to the bottom-most envelope 3 being fed into envelope printer 4. The arrangement of the bottom panel 16, deck 18, and side panels 12,14 position the envelope 3 for passage from the envelope hopper 1 to envelope printer 4.

The operation of the envelope hopper 1 of the present invention will be described with reference to FIG. 2. A stack of blank envelopes 2 are placed flap side down in the hopper 1. The envelopes are placed with their flaps resting on rollers 36, the body of the envelopes resting on support ramp 38, and the leading edge of the envelopes in contact with ribs 30. Most of the envelope stack weight distributes along the convex, curved deck 18. The geometry of the hopper 1 greatly minimizes the effect of the cumulative weight of the envelope stack 2 on the feed roller 60.

The stack of envelopes 2 are properly aligned for feeding to the envelope printer 4 by side guide 34 and aligner 50. A plurality of fingers 62 and feed roller 60 define a pass-through gap 24 for passage of the bottom-most envelope 3 in the stack of envelopes 2 from the envelope hopper 1 to envelope printer 4. Upon receipt of a feed signal from the printer control logic, a motor (not shown) is energized so as to rotate feed roller 60 counterclockwise. The plurality of fingers 62 located above feed roller 60 permit passage of a single envelope 3 through pass-through gap 24. The trail edge of the bottom-most envelope 3 enters the nip formed between rollers 63 and 64. Movement of the bottom-most envelope 3 continues under the control of rollers 63, 64, 65 and 66. The technique for controlling the ink jet print head 68 is conventional and is not, per se, a part of the present invention.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What is claimed is:

1. An envelope hopper for holding a stack of envelopes, comprising:

a rear panel;

a pair of side panels extending forward from the rear panel;

a convex, curved deck mounted to the rear panel, the deck extending between a rearmost section of the side panels, the deck having a convex receiving end and a straight feeding end for supporting a stack of envelopes, the deck having two sides for positioning the envelopes on the curved deck extending upwardly from the deck so that the deck will reduce the weight and compression of the stack at the feeding end of the deck by distributing the weight of the stack against the upper portion of the deck; and, a bottom panel positioned below the feeding end of the deck and extending between the side panels thereby positioning the reduced compression stack of envelopes for passage of a bottom-most envelope from the envelope hopper.

2. The envelope hopper as claimed in claim 1, wherein the bottom panel is oriented at a first acute angle with respect to a horizontal plane to reduce the overall height of the stack of envelopes.

3. The envelope hopper as claimed in claim 2, wherein the bottom panel is oriented at least 20 degrees with respect to the horizontal plane.

4. The envelope hopper as claimed in claim 2, further comprising a support ramp fixedly mounted to the bottom panel for supporting the stack of envelopes, the support plate is oriented at a second acute angle with respect to the horizontal plane, the second acute angle being greater than the first acute angle.

5. The envelope hopper as claimed in claim 4, wherein the support ramp is oriented at least 35 degrees with respect to the horizontal plane.

6. An envelope hopper as claimed in claim 4, further comprising means for supporting the foremost portion of the stack of envelopes.

7. The envelope hopper as claimed in claim 1, further comprising means for urging the stack of envelopes against one of the pair of side panels.

8. An envelope hopper as claimed in claim 1, further comprising a plurality of ribs extending from the deck for substantially the entire length of the deck.

9. An envelope hopper for holding a stack of envelopes, comprising:

a rear panel;

a pair of side panels extending forward from the rear panel;

a deck having a convex, curved top portion and a substantially linear bottom portion, the bottom portion of the deck mounted to the rear panel, the bottom portion of the deck extending between a rearmost section of the side panels, the deck having a receiving end and a feeding end for supporting a stack of envelopes and reducing the weight and compression of the envelopes at the feeding end of the deck, the deck having at least one convex, curved side extending upwardly from the top portion of the deck; and, a bottom panel positioned below the feeding end of the deck and extending between the side panels thereby positioning the reduced compression stack of envelopes for passage of a bottom-most envelope from the envelope hopper.

10. The envelope hopper as claimed in claim 9, wherein the bottom panel is oriented at a first acute angle with respect to a horizontal plane.

11. The envelope hopper as claimed in claim 10, wherein the bottom panel is oriented at least 20 degrees with respect to the horizontal plane.

12. The envelope hopper as claimed in claim 10, further comprising a support ramp fixedly mounted to the bottom panel for supporting the stack of envelopes, the support plate is oriented at a second acute angle with respect to the horizontal plane, the second acute angle being greater than the first acute angle.

13. The envelope hopper as claimed in claim 12, wherein the support ramp is oriented at least 35 degrees with respect to the horizontal plane.

14. An envelope hopper as claimed in claim 12, further comprising means for supporting the foremost portion of the stack of envelopes.

15. The envelope hopper as claimed in claim 9, further comprising means for urging the stack of envelopes against one of the pair of side panels.

16. An envelope hopper as claimed in claim 9, further comprising a plurality of ribs extending from the deck for substantially the entire length of the deck.

* * * * *